United States Patent [19]

Hunt

[11] Patent Number: 4,558,729

[45] Date of Patent: Dec. 17, 1985

[54] METHOD FOR HIGH VACUUM CASTING

[75] Inventor: Charles d'A. Hunt, Occidental, Calif.

[73] Assignee: Demetron, Inc., Union City, Calif.

[21] Appl. No.: 570,176

[22] Filed: Jan. 12, 1984

[51] Int. Cl.[4] ..... B22D 7/10

[52] U.S. Cl. ..... 164/122; 164/469

[58] Field of Search ..... 164/46, 462, 463, 469, 164/474, 122, 506, 422, 494, 61

[56] References Cited

U.S. PATENT DOCUMENTS

| | | | |
|---|---|---|---|
| 3,343,828 | 9/1967 | Hunt . | |
| 3,367,394 | 2/1968 | Roder et al. | 164/61 |
| 3,709,284 | 1/1970 | Hunt . | |
| 3,723,101 | 6/1970 | Hunt . | |
| 3,723,102 | 3/1973 | Lowe . | |
| 3,764,297 | 8/1971 | Coad et al. . | |
| 3,821,979 | 7/1974 | Paton et al. | 164/506 |
| 4,121,647 | 10/1978 | Paton et al. | 164/494 |
| 4,261,412 | 4/1981 | Soykan et al. | 164/495 |

OTHER PUBLICATIONS

Unit Processes of Extractive Metallurgy; Chapter 8, Melting, Pouring and Solidification, pp. 226–260.

*Primary Examiner*—Kuang Y. Lin
*Assistant Examiner*—Gerard M. Reid
*Attorney, Agent, or Firm*—Fitch, Even, Tabin & Flannery

[57] ABSTRACT

Method and apparatus for producing a fine-grain ingot are disclosed. A feedstock stick is melted to produce a series of fully molten drops which falls on the upper surface of an ingot being formed, to cover a portion thereof which is substantially less than the ingot's total upper surface. The mold is moved laterally with respect to the feedstock stick at a rate which is high enough so that the molten metal impinges upon different portions of the ingot's upper surface but which is low enough to prevent a substantial centrifugally outward flow of the metal impinging on the upper surface of the ingot. The molten metal melt rate is so selected that the impact region on the ingot's upper surface is at or below the solidus temperature of the alloy and above a temperature at which metallurgical bonding with the successive impinging metal can occur.

12 Claims, 4 Drawing Figures

METHOD FOR HIGH VACUUM CASTING

BACKGROUND AND SUMMARY

The present invention relates to metal casting, and more particularly, to a method for casting a fine-grain ingot.

The production of ingots by continuous casting is well known in the prior art. Generally, a continuous casting process employs a mold having a cooled outer wall and a movable bottom, or plug. Molten metal is poured into the top of the mold in a vacuum enclosure. As the metal solidifies, it is drawn downwardly by the plug while at the same time, additional molten metal is poured into the mold at the top.

Because heat loss from the ingot in this type of continuous casting process occurs primarily at the cooled mold walls and, downwardly, through the solidified portion of the ingot, the solidification of the molten metal in the newly poured ingot occurs at relatively low rates; for example, movement of the liquid-solid interface at rates slower than approximately 1/10 inch per minute in the central regions of the ingot is typical. For many materials, and particularly more complex alloys, the relatively slow solidification rate is accompanied by the growth of dendritic crystals having large arm spacings, and by significant segregation of various alloy constituents in the regions between the dendritic arms.

Conventionally cast ingots having dendritic crystal and segregation imperfections of the type mentioned above usually require heating—for example, at temperatures slightly below the alloy's solidus temperature, for periods of up to 24 to 36 hours—prior to being subjected to mechanical hot working operations such as rolling and forging. Even then, hot working of conventionally cast ingots of many complex alloys may be accompanied by so much surface cracking that some of these ingots are considered to be unworkable.

Another problem associated with conventional continuous casting processes known in the prior art is the formation of ruptures in an ingot sidewall during ingot casting. The ruptures, or so-called hot tears, are formed by frictional forces between the ingot and mold when the ingot is lowered in the mold before its sidewall regions have cooled sufficiently. For most purposes, hot tears constitute an unacceptable sidewall condition where further processing of the ingot is required.

A number of casting techniques for producing ingots which have reduced hot-tear and segregation problems have been proposed. Some newer casting techniques are designed particularly for the production of high quality, ultrahigh-strength alloy ingots which are suitable for rolling, forging or the like. U.S. Pat. No. 3,709,284, discloses a continuous casting method in which a water-cooled ram or plug periodically engages the top of the ingot during casting, to cool the ingot from its upper surface. The method involves contacting the cooling plug with each newly poured molten-metal layer, which may have a thickness of about 1/16 inch. Electron beam heating is used to heat the ingot's upper surface between solidification operations, to assure good bonding between the successive layers.

As the plug makes repeated contact with the upper surface of the newly poured increments, it begins to collect a surface contamination coating or deposit which is formed, in part, from metal vapors from the molten alloy. Since the coating which collects on the plug has a different composition than that of the alloy itself, the plug must be cleaned periodically to prevent the material from being introduced into the ingot melt. The need to keep the plug surface clean adds to the complexity and expense of the operation, and unless the plug is kept completely free of vapor coatings, some contamination of the ingot will occur. This process, therefore, is best suited for high-strength steels and other alloys that do not need to be ultra-clean.

In a second method which has been proposed for production of relatively uniform-grain ingots, partially molten material from a pair of consumable electrodes, heated by vacuum arc melting, drips onto the central upper surface of an ingot being formed in a spinning mold. As a partially molten drop hits the ingot surface, at the center of the spinning mold, it spreads out in a thin layer which covers the entire ingot upper surface.

Ingots produced by the spinning mold process may lack fine grain size, typically exceeding ASTM 3–4. The heated material which drops onto the ingot never reaches the liquidus temperature, and therefore the thin layers forming the ingot contain unmelted solid particles which can seed larger grains in the solidified ingot. The need for high rotational speeds in this process also introduces significant mechanical complexity to the apparatus.

Ultrahigh-strength alloys having a fine-grain crystalline structure may be produced by powder metallurgy. The powdered alloy can be converted to the equivalent of a billet by means of conventional hot pressing techniques, and such billets can then be converted to forged parts that exhibit excellent mechanical properties. However, powder metallurgy methods typically provide a relatively low yield of usable powder, and thus material costs are high. Additionally it is difficult to prevent damaging impurities from contaminating the powder.

It is one general object of the present invention to provide an improved method for producing fine-grain, high-strength alloy ingots.

A more specific object of the invention is to provide a method for producing an high-strength iron, nickel or cobalt-based ingot which can be hot rolled or forged directly without the need for extensive prior heat treating the ingot.

A related object of the invention is to provide a method for producing such an ingot that has a crystal grain size between about ASTM 5 and 7.

Yet another object of the invention is to provide a method for producing such an ingot of relatively large diameter, i.e., substantially greater than 6 to 8 inches (15 cm to 20 cm).

Still another object of the invention is to provide a method for producing such an ingot having a hollow interior.

It is still another object of the invention to provide, by such method, a high-strength iron, nickel or cobalt-based ingot having a grain size between about ASTM 5 and 7 when viewed on a surface cut transverse to the longitudinal axis of the ingot, and consisting of longitudinal grains ranging in length from about 1 mm to about 20 mm parallel to the longitudinal axis of the ingot.

According to the method of the invention, a feedstock stick is melted to produce either a continuous stream of molten metal or a series of fully molten drops. The metal falls on the upper surface of an ingot being formed, to cover a portion thereof which is substantially less than the ingot's total upper surface. The mold is moved laterally with respect to the feedstock stick so that the molten metal impinges upon different portions of the ingot's upper surface. The melt rate is so selected that the impact region on the ingot's upper surface is at or below the solidus temperature of the alloy and above a temperature at which metallurgical bonding with the impinging metal can occur.

The apparatus for carrying out the method of the invention includes a support for holding the feedstock stick, an electron beam for heating the stick, and an ingot mold which is shiftable laterally with respect to the support.

These and other objects and features of the present invention will become more fully apparent when the following detailed description of the invention is read in conjunction with the accompanying drawings.

DETAILED DESCRIPTION OF THE INVENTION

Figure 1:
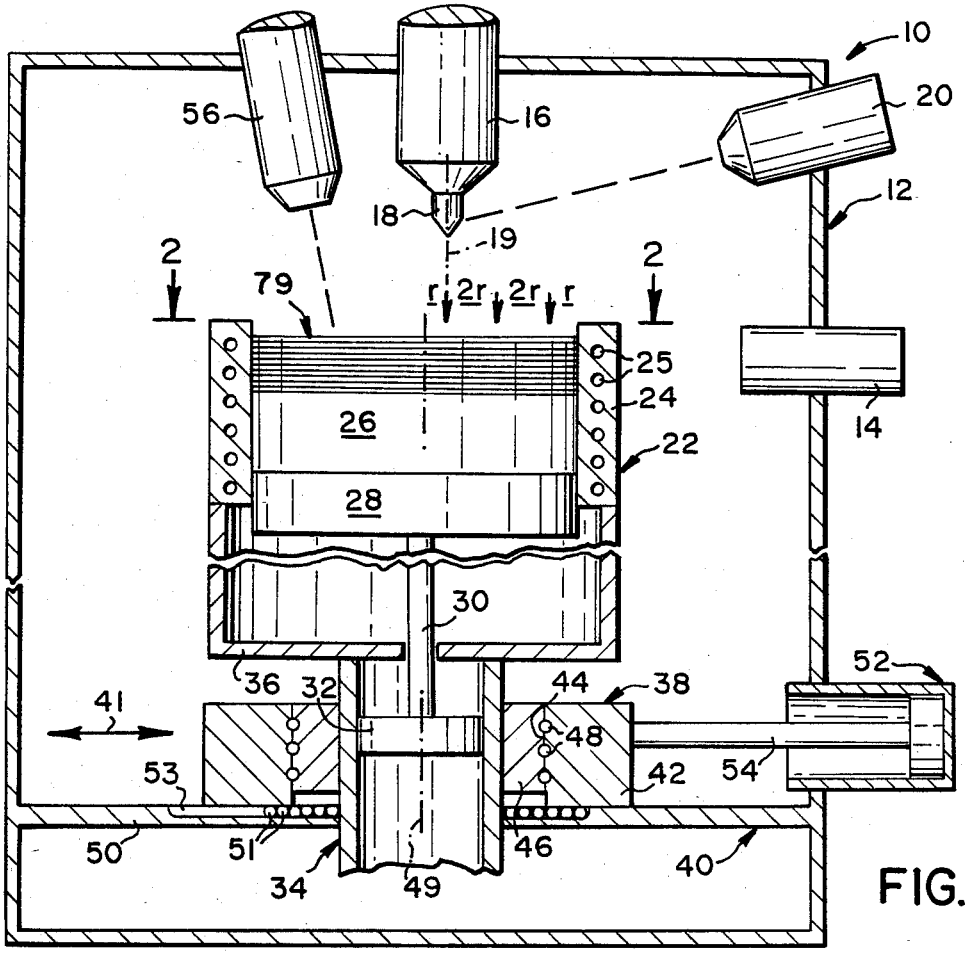
FIG. 1 is a diagrammatic sectional view of a high vacuum drop-casting apparatus for use in practicing the method of the invention.

FIG. 1 shows, in diagrammatic form, an apparatus 10 for forming a fine-grain alloy ingot according to the invention. Apparatus 10 includes a vacuum-tight enclosure or furnace 12 which can be evacuated to a desired pressure, preferably less than about $10^{-3}$ Torr by one or more vacuum pumps, such as a pump 14.

A feedstock support 16 in the apparatus is adapted to support a feedstock stick 18, the lower end portion of which is seen in the figure. The support is constructed to advance the stick in a downward direction in the figure, as the heated stick's lower end is depleted during ingot formation. Preferably, the support is designed to maintain the lower end of the stick a vertical distance between about 4 and 12 inches (10–30 cm) above the upper surface of the ingot being formed, and is constructed to rotate the stick about its central vertical axis, shown by dash-dot line 19.

One or more electron beam guns, such as gun 20, are provided for melting the lower end of the feedstock stick. The electron gun(s) may be either the self-accelerated or work-accelerated type, and may be mounted in the enclosure for adjustable movement to position the beam(s) at a desired position with respect to support 16. Magnetic deflection of the beam may also be used to adjust its position relative to support 16. Magnetic deflection means are built into the structure of electron guns commercially available from Leybold-Heraeus of Hanau, West Germany, and the von Ardenne Institute of Dresden, East Germany.

A continuous casting mold 22 in apparatus 10 includes a cylindrical housing 24 having coolant passages 25 in the walls thereof for circulation of a suitable coolant to withdraw heat being formed in the mold. A water-cooled plug 26 of suitable material is provided inside the housing to form the lower support for an ingot formed in the mold. The plug is supported on a plate 28 which is connected by a rod 30 to a piston 32 in a conventional hydraulic cylinder 34. The vertical position of plug 26 is controlled conventionally by suitable hydraulic control of cylinder 34. The cylinder is rigidly attached at its upper end to a lower base 36 in the mold housing, with rod 30 being slideably received through a central opening in the base. Of course, other control means could be used to position the plate 28, such as a ball screw drive system.

According to an important feature of the invention, apparatus 10 includes means for producing relative movement between mold 22 and support 16. This movement allows molten metal from the heated feedstock stick to impinge upon different portions of the upper surface of the ingot being formed in the mold, in a manner to be described. Movement means in apparatus 10 includes a cart 38 on which mold 22 (including mold housing 24 and attached cylinder 34) is mounted for rotation about the mold's vertical axis, and cart-mounting structure, indicated generally at 40, mounting cart 38 for reciprocal lateral motion in the directions indicated by arrow 41 in the figure.

Cart 38 includes an outer support member 42 which is carried on a structure 40, and which defines a inner circular bearing surface 44 in the cart. An inner annular member 46 in the cart is mounted within the inner bearing surface of member 42, by bearing balls 48 for rotational movement with respect to member 42 about its central vertical axis, which coincides with the central axis of mold 22. A suitable hydraulic system (not shown) is operable to produce a selected-speed rotation of inner member 46 with respect to outer member 42, for a purpose to be described.

Mold 22, and particularly cylinder 34 therein, is rigidly mounted in a central opening in member 46 for rotation therewith about the mold's vertical axis, indicated by dash-dot line 49 in the figure. It can be appreciated that the just-described mold, including housing 24 and plug 26 which is vertically movable therein, is rotated as a unit with inner member 46.

Mounting structure 40 generally includes a pair of parallel tracks, such as track 50, mounted on and extending between opposed walls in enclosure 12. Cart 38, and particularly outer member 42 therein, is carried on the tracks by roller balls or the like, such as balls 51, for shifting movement along the tracks. The roller balls ride in a suitable grooves formed in the lower surface of member 42 and in the mounting structure tracks. Groove 53 in track 50 is seen in FIG. 1. It is noted that cylinder 34, a portion of which extends below the tracks, is disposed between the two tracks in mounting structure 40.

Shifting means for moving the cart and attached mold selectively to the right or left in the figure is provided by a second hydraulic cylinder 52 mounted on one of the enclosure walls, as shown, and connected to the cart by a rod 54. For purpose of illustration, the apparatus will be assumed to a have a mold radius, as measured by the radial distance between the mold's center axis and its inner wall, of 6 inches (15 cm). With the cylinder in its retracted position, as shown in FIG. 1, the mold is positioned with its central axis 49 offset from drip axis 19 by a radial distance r, as shown. The significance of r, which is here assumed to equal one inch or 2.5 cm, will become clear below. With mid extension of cylinder 52, the mold is moved toward the left in the figure a distance 2r (2 inches or 5 cm), to a position where drip axis 19 is spaced a radial distance 3r (three inches 7.5 cm) from the mold's central axis. Movement of the cylinder to its fully extended position carries mold 20 an additional distance 2r to the left in the figure to a position where mold drip axis 19 is spaced a radial distance 5r (five inches or 12.5 cm) from the center axis of the mold.

Completing the description of what is shown in FIG. 1, apparatus 10 includes a second electron gun system, represented here by electron gun 56, which is operable to provide electron-beam heating of the upper surface of the ingot being formed in mold 22. The one or more electron guns, such as gun 56, in the electron-gun system are substantially identical to that of above-described gun 20, and are movable either for electron-beam scanning of the upper surface of the ingot being formed, or for directing the beam(s) at selected positions on the mold's upper surface. Adding heat by electric beam to the top surface of the ingot is generally undesirable, except at the end of a run, when it is sometimes desirable to reduce the rate of cooling of the top surface of the ingot to prevent shallow cracks from developing there.

Production rate is limited by the rate of heat loss from the top surface of the ingot during the thin-layer casting operation. Therefore the impingement of electron beams on this surface during the casting operation constitutes an undesirable heat source that reduces the maximum production rate possible in this type of operation.

The operation of apparatus 10, as it is used in practicing the method of the invention, will now be described. The feedstock stick placed in support 16 includes a stick or cylinder of the alloy metal from which the ingot is formed. The present invention is particularly useful in connection with nickel- or cobalt-based alloys containing at least about 50% nickel or cobalt, respectively, and between about 10% and 20% chromium. Alloys of this type that contain significant fractions of aluminum and titanium, as well as higher melting point elements such as niobium, molybdenum, and tungsten, are known as superalloys, being characterized by relatively broad liquidus-solidus temperature ranges, typically between about 120° F. and 300° F. (65° C. and 150° C.).

The electron-beam gun or guns in the feedstock beam heating system, such as gun 20, are aimed at the lower end of the feedstock stick to produce fully molten drops at the bar's lower end. The electron beam, or beams, preferably make a 10° to 30° angle with the horizontal, as shown. The desired feed rate is established by setting the rate of downward movement of the feedstock stick in support 16. The total electron-beam power is adjusted to a level about 10% to 30% greater than that necessary to melt completely the lower end of the feedstock stick as it moves downward into the beam. By way of example, a beam power of about one-fifth kilowatt total beam power per pound of melt per hour has been used for nickel-based superalloys. This total beam energy may be supplied by one electron beam gun aimed at one side of the feedstock stick, as shown in FIG. 1, or by a series of guns arrayed within the enclosure to irradiate the feedstock bar's lower end from different sides. It is generally necessary to rotate the stick in support 16, about the stick's central vertical axis, to produce even heating at the stick's end, and insure dripping along the stick's vertical axis 19. This axis is also referred to herein as the drip axis.

When molten metal hits the upper surface of an ingot being formed in the mold, it forms a film-like spatter which covers a portion of the upper ingot surface that is substantially less that the total upper ingot surface. Fully molten metal of a superalloy of the type described above, falling a distance of between about 4 and 12 inches (10–30 cm) from the stick to the upper surface of the mold, typically forms a roughly circular spatter having a diameter of between about 1.5 and 2.5 inches (3.8 and 6.2 cm), and a fairly uniform spatter thickness of between about 15 and 30 mils (0.04 to 0.08 mm). For purposes of the present discussion, the average spatter will be assumed to have a surface dimension of about 2 to 2.5 inches (5 to 6.2 cm) and a thickness of about 20 mils (0.05 mm). The radius of the spatter is thus about 1 to 1.25 inch, which is equal to or greater than r.

According to an important feature of practicing the invention, mold 22 is moved laterally with respect to drip axis 19, at a rate which is high enough to lay down a close-packed array of spatters which form each of the successive ingot layers. Lateral movement of the mold includes both translational movement (in a left/right direction in FIG. 1) and rotational movement about mold axis 49. The relative movement is low enough, however, so as to prevent a substantial centrifugally outward flow of molten metal impinging on the top surface of the ingot. This avoids uneven buildup of metal on the ingot which is significant in preventing limitations on production rates due to excessive buildup at the periphery of the ingot.

Figure 2:
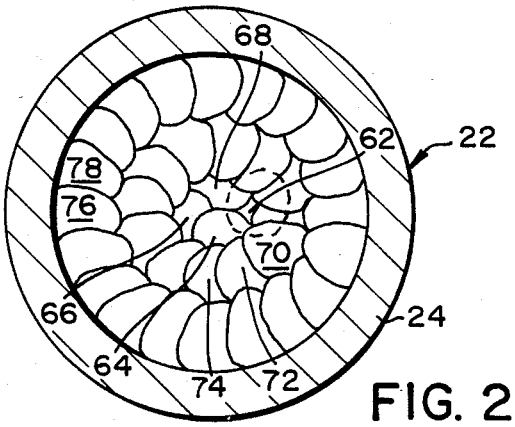
FIG. 2 is a sectional view of a mold in the apparatus, taken generally along line 2—2 in FIG. 1, showing the upper surface of an ingot in the mold during the formation of an ingot surface layer.

Describing a typical operation of apparatus 10 in producing such a spatter array, with the mold in the lateral position shown in FIG. 1, a molten drop from the feedstock stick forms a substantially circular spatter, such as spatter 62 seen in dotted outline in FIG. 2, extending from the center of the mold radially outwardly about 2.25 inches. By rotating the mold in a specified direction, e.g., counterclockwise in FIG. 2, at a selected speed, the next drop falling on the ingot forms a spatter, such as spatter 64, which is adjacent the previously formed spatter 62.

Spatter drops can overlap by as much as about 70% to 85% (diametrically). The critical factor is not the overlap or lack of overlap but rather the average rate of vertical buildup of solidified metal. For super alloys, this average rate of vertical buildup cannot exceed about 0.4 inches (1 cm) per minute without the occurrence of molten areas on top of the ingot, with attendant substantial increase in grain size. Also if the rate of lateral movement is so slow that the short-time average of local buildup rates exceeds about 0.4 inches (1 cm) per minute for periods exceeding about 10 seconds, then the surface of the local areas upon which the drops are impinging will remain molten for periods longer than about one second, with resulting local increase in grain size of the solidified ingot. Some degree of overlap is generally desirable to obtain a smoother ingot side wall and to minimize the possible occurrence of unfilled areas at borders between splatters. Too much overlap, however, can create the situation noted above concerning excessive short-time average rates of local buildup. Thus, for any feed rate, there is a particular average rate of ingot buildup that results; and that rate (average) must not exceed about 0.4 inches (1 cm) per minute. Then, the cycle repeat time cannot exceed about 15 seconds without having the possibility of inadequate bonding between layers.

In addition to following the aforesaid limitations on overall ingot buildup rate, care must be taken to avoid localized pooling of molten metal. Such pooling results in undesireable non-uniformity of grain structure. It is preferred that the local short-time buildup not exceed 0.4 inches per minute for a period exceeding about 10 seconds.

Continued rotation of the mold, through substantially one rotation in the direction indicated FIG. 2, causes the next two molten drops to form spatters 66, 68. As seen, these four spatters 62, 64, 66, 68 form a nearly continuous layer or covering extending approximately 2 to 2.25 inches radially outwardly from the center of the mold.

The mold is now shifted translationally, by activation of cylinder 52, to a position where axis 19 is offset about 3 inches (7½ cm) to the right of axis 49 in FIG. 1. With the mold so positioned, the next impinging drop then will form a spatter, such as spatter 70, seen in FIG. 2, whose center is about 3 inches (7½ cm) from the center of the mold. The mold is again rotated in the specified direction, at a now-slower rotational speed, through substantially one rotation, to produce a second annular "ring" of spatters, including spatters 70, 72, 74, which extend the surface covering on the upper surface of the ingot a distance about 4 to 4.25 inches from the center of the mold.

Finally, the mold is moved translationally by full extension of cylinder 52, to the position where axis 19 is offset about 5 inches (12½ cm) from the center of axis 49. The mold is then rotated at a further reduced speed, through substantially one rotation, to lay down a outer annular ring of spatters, including spatters 76, and 78 to form a new ingot layer having a thickness of about 20 mils (0.05 mm).

The mold rotational speeds required to attain the spatter pattern just described depend, of course, on the drip rate of molten drops impinging on the mold upper surface. The drip rate is an important parameter in the practice of the invention and will be discussed in detail below. For purposes of the present discussion, the drip rate will be assumed to be about 5 drips per second. To form the innermost ring of spatters, composed of four or more spatters, the mold must be rotated at about 60 rpm or less, allowing deposit of the first four drops in 4/5 second or longer.

The approximately 12 or more spatters forming the central annular region, including spatters 70, 72, 74, are deposited in the next 2 and 2/5 seconds or longer, requiring a mold rotational speed of about 23 rpm or less. Finally, the approximately 20 or more spatters forming the outer circle are deposited in approximately 4 or more seconds, requiring a mold rotational speed of about 15 rpms or less.

Thus, as the mold is moved in a right-to-left direction in the figure to form increasing-radius annuli or rings of spatters, the rotational speed of the mold is progressively decreased. After completing the cycle, the mold is retracted to its initial position shown in FIG. 1 and the procedure is repeated, to build up increasing ingot layers. Periodically, plug 26 in the mold is retracted to accommodate the buildup of ingot layers in the mold. The ingot being formed in mold 22 is indicated at 79 in FIG. 1.

Figure 3:
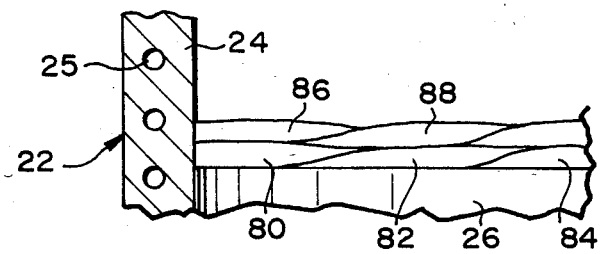
FIG. 3 is a sectional view taken generally along line 3—3 in FIG. 2, illustrating the overlapping of successive layers in the ingot being formed.

As seen in FIG. 2, the top layer in the ingot, which is formed as an array of spatters as just described, is formed of thin overlapping spatters. The edges of these spatters form depressions in the ingot's upper surface which tend to be filled and average out to a fairly level surface as the next spatter layers are formed, as will now be illustrated with reference to FIG. 3. Spatters 80, 82, 84, which are shown enlarged and in exaggerated cross-sectional thickness in FIG. 3, represent spatters which were layed down in a previous layering operation of the type just described. As the next layer of spatters, including spatters 86, 88, is laid down, molten spatter material flows into and fills the edge regions in the immediately preceding layer, as shown. Edge fusion of splatters occurs naturally, without the need for electron beam assistance.

The rate at which successive layers are formed is such that the drop impact region on the ingot's upper surface is at or below the solidus temperature of the ingot alloy and above a temperature at which metallurgical bonding with the successive impinging drops can occur. Empirically, for the super alloys of the type described herein, the cycle rate—defined herein as the rate at which successive drops impinge on substantially the same surface portion of the ingot's upper surface—is between about 3 and 15 seconds. If the rate of successive impingement of molten drops at a given location is more than about one every three seconds, a molten pool begins to collect in the ingot upper surface, leading to slower solidification and a coarser grain size in the ingot being formed. At a cycle rate of more than about 15 seconds, good metallurgical bonding between successive overlayed spatters may not be achieved. For alloys of the type mentioned, good metallurgical bonding occurs where the impact region is between about 50° F. and 200° F. (28° C. and 110° C.) below the solidus temperature of the ingot alloy. Photomicrographic examination has shown that there is a growth of dendrites vertically across the boundary between spatters.

The cycle rate defines the time required to deposit all of the spatters forming one layer. Therefore, the cycle rate will depend on the drip rate of molten drops from the feedstock stick. By way of illustration, a 12-inch diameter ingot surface as seen in FIG. 2 may be covered by approximately 36–42, 2 to 2.5 inch diameter spatters with overlap sufficient to leave no uncovered areas. At a drip rate of about 7 drops per second, the entire surface of the ingot can be covered approximately every 6 seconds, the cycle rate of operation.

By way of further example, a drip rate of 0.7 drops per second (1/9 the above rate) builds up a 4 inch diameter ingot approximately at a rate of about 0.2 inches (0.5 cm) per minute, as would a 6 second cycle on a 12 inch ingot.

Of interest here is the fact that a feed rate of 12 drips per second would give a buildup rate of about 0.4 inches (1 cm) per second, the estimated maximum possible upper limit of production. The cycle time of 6 seconds in this case corresponds to about 50% overlap of droplets, which is satisfactory. The local short-time average spatter impingement time is still quite brief (nowhere near the 10 second limit).

Ingots formed by the apparatus and method of the invention, and having the super alloy composition described above, have a uniform transverse grain size in the range ASTM 5 to ASTM 7. By contrast, superalloy ingots formed by continuous-casting processes used in the prior art have nonuniform grain sizes ranging from an ASTM grain size of about 00 and greater, in the internal slow-cooling regions of the ingot, to grain sizes of between about ASTM 0 and 1 for the faster cooling edge regions. The importance of practicing the present invention within the specified cycle rate range is illustrated by the fact that in ingots formed under conditions where molten surface pools of materials were observed, at a buildup of more than about 0.4 inches (1 cm) per minute, the grain structure observed in the ingot was between about ASTM 2 and ASTM 3.

Figure 4:
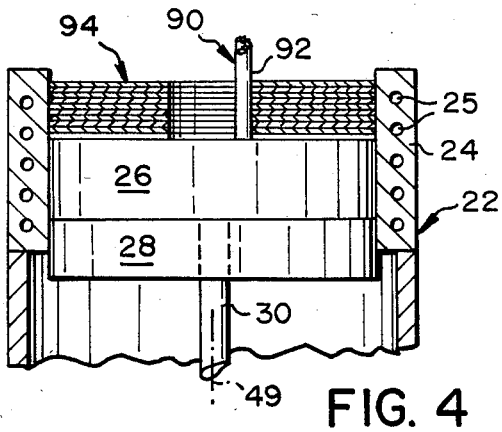
FIG. 4 shows an alternative embodiment of the apparatus, where the mold of FIG. 1 is equipped with a inner curved wall member used in forming an ingot having a hollow cylindrical interior.

The production of a fine-grain ingot having a hollow cylindrical interior can be accomplished with minor modifications of the apparatus and method just described. Fragmentary portions of a mold used in forming such an ingot according to the method of the invention are shown in FIG. 4. As seen, the mold includes, in addition to the cylindrical housing 24 and plug 26 described with reference to FIG. 1, an inner water-cooled mold member 90 defining an arcuate outer surface 92 which, with the member mounted in mold housing 24, is substantially concentric with the interior of the housing walls. Mold member preferably has an arcuate expanse of between about 10° and 20°, and is tapered about 1° to 2° on progressing upwardly to compensate for shrinkage of the ingot's hollow interior as the ingot cools. The member's outer surface is provided with a hard surface, for example, a hard chrome plating. The mold member is mounted in the upper portion of the mold housing for shifting with the mold in the reciprocal left/right directions in the figure, but remains stationary with respect to the rotational movement of the mold, and also with respect to vertical movement of plug 26.

In operation, the mold is initially positioned to place the outer surface of member 90 between the drip axis and the mold's rotational axis, such that the spatter formed from a molten drop will abut and be defined radially inwardly by the member's outer surface. Continued rotation of the mold and deposition of spatters adjacent the mold member results in an annular spatter layer having a circular inner edge. The mold is then moved translationally, as described above, to form additional greater-diameter annular rings required to build up each ingot layer. As the ingot layers are formed, plug 26 is retracted to lower the ingot in the mold, but still keeping the upper surface of the ingot above or at the level of the lower surface of the mold member. It can be appreciated that continued layer buildup in the fashion results in an ingot having a hollow cylindrical interior, shown here at 94. The ingot formed has a grain structure which is substantially identical to that in the solid ingot described above. A hollow ingot can also be cast without using an inner mold section. The inner surface is, of course, quite rough, in this case; and the annular wall thickness cannot be less than about 2 inches, the diameter of the spatters.

The method of the invention provides a number of important advantages over ingot-forming methods known in the prior art. By forming an ingot as a series of very thin, substantially uniform layers which are allowed to solidify before the deposition of the next-up layer, a superalloy ingot is formed having a very fine uniform grain structure throughout the ingot in the range ASTM 5–7. The finer grain structure in the ingot allows the ingot to be rolled or forged directly without expensive, often destructive hot working operations. Superalloy ingots of the type produced herein are particularly valuable in the production of high temperature alloy parts required in jet engines and the like.

The apparatus of the invention can be readily designed and scaled to produce ingots having diameters of 8 inches (20 cm) or larger and/or hollow interior ingots. The present invention provides another significant advantage over prior art drop casting procedures in that the material dripped onto the mold in the present invention is fully molten, and therefore is capable of producing a finer grain size upon hardening than where the dripped material is partially crystallized.

The following examples are illustrative of the method of the invention, but are not intended to limit the scope thereof.

EXAMPLE I

An ingot of nickel-base superalloy was cast according to this method, using electron beam refined feed stock, of the composition "GMR 235" (General Motors Research 235).

The feed stock was 3 inches (7.5 cm) diameter and 8 inches (20 cm) long. It was rotated at a rate of about 5 r.p.m. and fed downward at a rate that gave fully molten electron beam melted drops at a rate of 0.8 drops per second. The ingot buildup rate was about 0.2 (0.08 cm) per minute.

The top of the ingot being formed was maintained at a height that caused a drip height of about 4 inches (10 cm).

The ingot was rotated at a rate of about 5 r.p.m., the vertical axis of rotation displaced about $\frac{7}{8}$ of an inch (2 cm) laterally from the vertical axis of rotation of the feed stock (the axis of dripping, also, of course). The spatters overlapped about 50% diametrically.

No external mold surface was used, the ingot O.D. being determined by the solidification of the spatters. The rough O.D. of the resulting ingot was about 4 inches (10 cm). The roughness was about $\frac{1}{8}$ inch (0.05 cm) deep and was removed by machining the ingot on a lathe to obtain a smooth ingot, about 5 inches (12 cm) long. The transverse grain size was ASTM 5 to 7, and the longitudinal section showed that the grains parallel to the ingot axis were about 1 mm to 10 mm long and did not reflect any grain growth phenomona affected by the layer interfaces, which were 0.020 inches (0.008 cm) thick.

EXAMPLE II

The experiment of Example I was repeated, except the drip height was 8 inches (20 cm). The conditions were otherwise the same, and the results were also the same.

EXAMPLE III

The experiment of Example I was repeated, except that the drip axis and the ingot rotation axis were displaced about $1\frac{1}{4}$ inches. A hollow ingot with a rough hole along the central axis was cast. The internal and external roughnesses were each about $\frac{1}{8}$ inch (0.05 cm) deep. The hole was about $\frac{1}{2}$ inch (1.25 cm) diameter rough and about $\frac{3}{4}$ inch (1.8 cm) diameter as smooth-machined. Grain structure was the same as in the solid ingots.

EXAMPLE IV

A larger ingot of nickel-base superalloy could be cast as follows:

Using a drip rate of about 2.4 drops per second and a drip height of about 8 inches (20 cm), the ingot is rotated alternately at axis displacements of about 1 inch (2.5 cm) and about 3 inches (7.5 cm) with one revolution at each radius for each dual-radius cycle. The rate of rotation at the one inch (2.5 cm) radius is 15 r.p.m., and 5 r.p.m. of the large radius.

An external water-cooled mold about 8 inches (20 cm) diameter would define the outer surface, which would have a roughness of about 1/16 of an inch (0.025 cm).

The ingot buildup rate would be about 0.2 inch (0.08 cm) per minute. The ingot grain structure would be the same as in the smaller ingots, and would be relatively uniform from edge to center and from top to bottom.

EXAMPLE V

A high strength alloy steel ingot (e.g. type 4340 steel) could be cast in the same apparatus and under the same conditions as for the nickel-base superalloy of Example IV. Grain size and shape would be approximately the same as for the superalloy.

While preferred embodiments of the invention have been described herein, it will be apparent to those skilled in the art that various modifications and changes may be made in the apparatus and method of the invention without departing from the scope thereof, as defined by the following claims.

What is claimed is:

1. A method of casting a superalloy ingot which is a nickel- or cobalt-based alloy containing at least about 50% nickel or cobalt, respectively, and between about 10% and 20% chromium, from a stick at high vacuum comprising:

melting the stick using one or more electron beams to produce a substantially linear series of fully molten drops, each drop of which falls on the upper surface on an ingot being formed to cover a portion thereof which is substantially less than the ingot's total upper surface, controlling the electron beam heating rate and the distance of the stick above the upper surface of the ingot such that each drop forms a film-like spatter having a surface dimension of between about 3.8 and 7.6 centimeters and wherein the thickness of the spatter is between about 0.04 mm and 0.08 mm, providing relative movement between the stick and the ingot being formed at a rate which is high enough so that the successive drops will impinge upon different portions of the ingot's upper surface to lay down a series of substantially level close-packed arrays of overlapping spatters, each array covering the upper surface of the ingot substantially uniformly, but which rate of relative movement is low enough to prevent a substantial flow of the spatters on the surface of the ingot, and maintaining the drip rate such that the impact region on the ingot's upper surface is at or below the solidus temperature of the superalloy and above a temperature at which metallurgical bonding with the successive impinging drops can occur and such that the average rate of vertical buildup of the ingot is less than or equal to about one centimeter per minute and the drop pattern is sufficiently uniform to avoid successive drop impingements in the same area at intervals less than about three seconds to thereby avoid localized pooling.

2. The method of claim 1, wherein the metal includes an alloy having a liquidus-solidus temperature range between about 65° C. and 150° C.

3. The method of claim 1, wherein the cast ingot has a crystal grain size of between about ASTM 5 and 7.

4. The method of claim 1, wherein the stick is rotated about a vertical axis to produce even heating thereof, and the drops fall from the stick substantially along such axis.

5. The method of claim 1, wherein the stick is supported about 10 and 30 centimeters above the ingot surface.

6. The method of claim 1, wherein the ingot is formed on a retractable plate in a mold, and the method further includes retracting the ingot as required upon buildup of the ingot in the mold.

7. The method of claim 1, wherein the drops fall along a substantially fixed drip axis, and wherein the ingot is rotated about a central vertical axis in the mold which is offset from the drip axis.

8. The method of claim 7, wherein the mold's central axis is shiftable translationally with respect to the drip axis.

9. The method of claim 7, wherein the mold is moved with respect to the drip axis to form a series of substantially overlapping rings, each ring being formed by moving the mold's central axis to a selected position with respect to the drip axis, and rotating the mold about such axis through substantially one revolution.

10. The method of claim 1, wherein the drip rate is maintained so that the impact region of the ingot's upper surface is between about 28° CF. and 110° C. below the solidus temperature.

11. The method of claim 10, wherein the feedstock melt rate is maintained so that the time interval between successive overlapping drop impingements is no more than about 15 seconds.

12. The method of claim 1, wherein the ingot has a hollow interior by virtue of applying molten metal to outer annular portions of the mold only.

* * * * *